US005292112A

United States Patent [19]

Hirota et al.

[11] Patent Number: 5,292,112

[45] Date of Patent: Mar. 8, 1994

[54] IMAGE FORMING APPARATUS

[75] Inventors: Kazuhiro Hirota; Kohji Yoshie, both of Tokyo, Japan

[73] Assignee: Konica Corporation, Japan

[21] Appl. No.: 974,476

[22] Filed: Nov. 12, 1992

[30] Foreign Application Priority Data

Nov. 28, 1991 [JP] Japan ..... 3-314818
May 27, 1992 [JP] Japan ..... 4-135205

[51] Int. Cl.[5] ..... B65H 1/00

[52] U.S. Cl. ..... 271/3.1; 271/145; 271/161

[58] Field of Search ..... 271/3.1, 21, 9, 145, 271/161

[56] References Cited

FOREIGN PATENT DOCUMENTS 254430 11/1986 Japan ..... 271/161
36122 2/1991 Japan ..... 271/161

*Primary Examiner*—Richard A. Schacher
*Attorney, Agent, or Firm*—Jordan B. Bierman

[57] ABSTRACT

A sheet feed cassette for loading a recording sheet for an image forming apparatus in which the recording sheet can be loaded in a form of U between a lower supporting base and an upper casing member. The cassette further includes a sheet delivery guide member disposed between the supporting base and the casing member, wherein the U-shaped recording sheet is folded around the sheet delivery guide member.

8 Claims, 7 Drawing Sheets

IMAGE FORMING APPARATUS

BACKGROUND OF THE INVENTION

The present invention relates to a sheet feed cassette which is equipped in an image forming apparatus such as a copying apparatus or a printer, and especially relates to a structure of the sheet feed cassette in which a large-sized recording sheet such as size A3 or A2 can be loaded.

Generally, in an image forming apparatus such as a copying apparatus or a printer, recording sheets of sizes of, for example, B5, A4, or B4 are frequently used and a plurality of sheet feed cassettes in which these recording sheets are loaded separately according to their sizes, or a universal cassette in which different sized recording sheets are loaded together, are equipped. When large-sized recording sheets such as A3 or A2 are used, large-sized sheet feed cassettes in which these recording sheets can be loaded are prepared for the image forming apparatus.

However, for example, when an A2 sized recording sheet is loaded, a conventionally used large-sized sheet feed cassette is inevitably larger than size A2 when a guide member or a regulation member for conveyance is included in the cassette. That is, it is large, heavy, its handling property is not good and its manufacturing cost is high.

The first object of the present invention is to solve the above-described problem and to provide a sheet feed cassette for an image forming apparatus which is light, has good handling property, and is low cost even when a large-sized recording sheet such as A3 or A2 is loaded.

Further, when the large-sized cassette is used with a publicly known ADU (Automatic Duplex Unit) which is built into the image forming apparatus, there is a problem that the image forming apparatus inevitably becomes large. Therefore, the present invention relates to an intermediate stacker on which a large-sized recording sheet such as a sheet of size A2 can be stacked, in the case of the image forming apparatus in which an ADU having the intermediate stacker is provided, wherein recording sheets, one side of which has been copied, are stacked on the intermediate stacker prior to two-sided copying.

Generally, when recording sheets apart from those commonly used are used, it is necessary to prepare a sheet feed cassette for exclusive use. Especially when a large sized recording sheet such as A2 is used, not only a large-sized sheet feed cassette is necessary, but also it is necessary to move the image forming apparatus itself or other apparatus in order to equip the sheet feed cassette in the image forming apparatus.

In order to solve these problems, intermediate stackers mounted in the image forming apparatus, by which two-sided copying can be performed, used as sheet feed units, have been proposed in the specifications of Japanese Patent Publication Open to Public Inspection Nos. 205548/1985 and 151555/1986. In these proposals, different size recording sheets which are commonly used can be loaded in the stacker. However, a large-sized recording sheet such as A2 can not be loaded therein.

The second object of the present invention is to provide an image forming apparatus in which the intermediate stacker provided in the ADU can be used as a sheet feeding unit for a large-sized recording sheet as a result of improvement of the forgoing problems.

SUMMARY OF THE INVENTION

The first object of the present invention is accomplished by a sheet feeding cassette for use in an image forming apparatus in which large-sized recording sheets are loaded and which can be detachably provided in the image forming apparatus, the sheet feeding apparatus comprising: a supporting base; a casing member for the recording sheets, one end of which is connected with the supporting base, and which is folded in the manner that it can be opened and closed; a regulation member which regulates the position of the recording sheets; and a sheet delivery guide member, wherein the recording sheet is loaded between the supporting base and the casing member, which is folded almost in parallel with the supporting base.

The second object of the present invention can be accomplished by an image forming apparatus in which two-sided copying can be performed and an intermediate stacker is provided in which recording sheets, one side of which has been copied, are stacked before the other side is copied, the image forming apparatus being characterized in that: large-sized recording sheets are loaded in the intermediate stacker in the manner that the recording sheets are folded gently; and the recording sheets can be fed when one-sided copying is performed.

DETAILED DESCRIPTION OF THE PREFERRED EMBODIMENT

Figure 1:
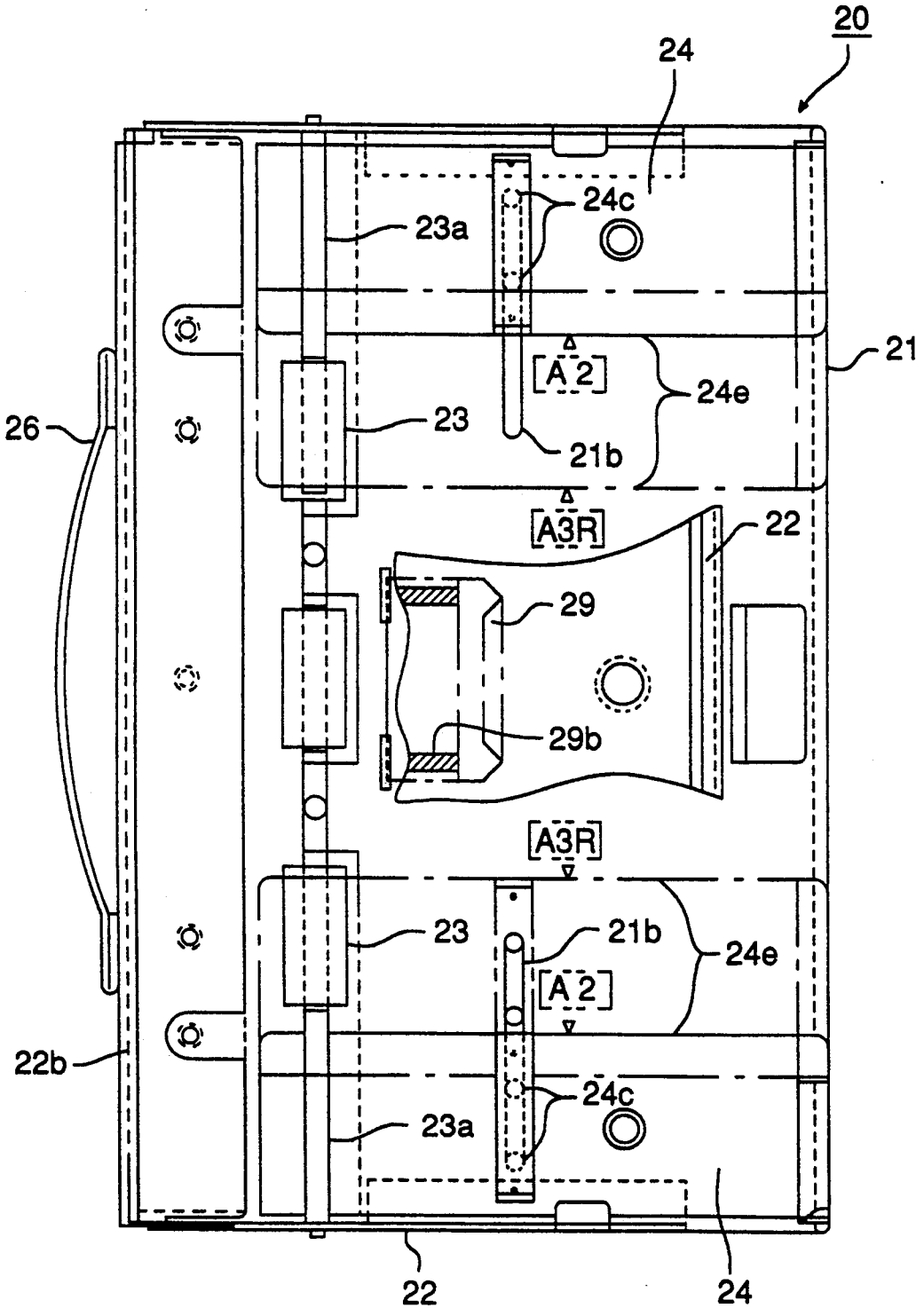
FIG. 1 is a plan view showing a structure of a sheet feed cassette according to one example of the present invention.

The first embodiment of the present invention will be explained as follows referring to a plan view showing a structure of a sheet feed cassette, shown in FIG. 1, a side view of FIG. 1, a side view showing a condition of the sheet feed cassette when it is opened, shown in FIG. 3, and a side sectional view showing a structure of an image forming apparatus, shown in FIG. 4. However, the present invention is not limited to the embodiment.

In an electrophotographic image forming apparatus, a platen glass P on which an original document M is placed is provided on a main body 1 of the image forming apparatus 18, and a scanning optical system 2 is provided under the platen glass P. The optical scanning system 2 comprises: an original document irradiation lamp 2*a* which reciprocates; a first mirror 2*b*; a second and third mirrors 2*c* which form a V-shape; a fixed lens 2*d*; and a fourth mirror 2*e*. A photoreceptor drum 3 is provided in the center of an inner portion of the main body 1 in the manner that the photoreceptor drum can be rotated in an arrowed direction. Around the photoreceptor drum 3, the following units are provided successively in the direction of rotation: a charging electrode 4 by which the photoreceptor 3a is uniformly charged; developing units 6 to which toner is supplied by a toner supply unit 5 and in which a developing sleeve 6a is built; a transfer electrode 7; a separation electrode 8; a discharging electrode 9; and a cleaning unit 10. Two kinds of recording sheets of different sizes are loaded respectively in sheet feed cassettes 11 and 11', and they are set in the main body 1. Numeral 12 is a first sheet feed roller by which the recording sheet loaded in the sheet feed cassette 11 is fed to a standby position before a second sheet feed roller 13, and comprises rollers 12a which are rotated through a belt in order to prevent the recording sheet from double-feeding, and a stop roller (called also a handling roller) 12b. Numeral 13 is a second sheet feed roller by which the recording sheet fed by the first sheet feed roller 12 is stopped once in the standby position and after that, the recording sheet is fed again to a transfer position in appropriate timing so that a leading edge of a visualized image on the photoreceptor 3a is coincident with a leading edge of the recording sheet in the transfer position. Numeral 14 is a guide plate which guides the recording sheet fed by the first sheet feed roller 12 to a position of the second sheet feed roller 13, and is opened and closed by a lever (not shown in the drawing) so that a jammed sheet can be ejected by hand. Numeral 15 is a conveyance unit which conveys the recording sheet, on which an image has been transferred, to a fixing position. A fixing unit 16 comprises a heat roller 16a and a pressure contact roller 16b. Numeral 17 is a sheet delivery roller by which the fixed recording sheet is delivered to the outside of the main body.

In the above-described apparatus, when a copy button is pressed, the original document M on the platen glass P is scanned by the optical scanning system 2, and an electrostatic latent image of the original document M is formed on the photoreceptor 3a of the photoreceptor drum 3. The electrostatic latent image is developed into a visualized image by developing units 6, and it is transferred onto the recording sheet fed from either of sheet feeding cassettes 11 and 11' provided in the main body by the transfer electrode 7. After this transferring, the recording sheet is separated from the photoreceptor 3a by the separation electrode 8, conveyed by the conveyance unit 15 to the fixing unit 16, fixed by the fixing unit and delivered by the sheet delivering roller 17.

Due to the foregoing, desired toner images are recorded successively onto the recording sheets.

Further, depending on the image forming apparatus, there is a case where the publicly known ADU (Automatic Duplex Unit) is built in the apparatus, a sheet feed cassette in which, for example, a large-sized recording sheet or a special sheet is loaded is mounted to the apparatus, and automatically feeds the sheet to the above-described conveyance system and the toner image on the photoreceptor drum 3 is transferred onto the recording sheet.

The sheet feed cassette of the present invention in which a large-sized recording sheet is loaded is structured as follows.

Figure 2:
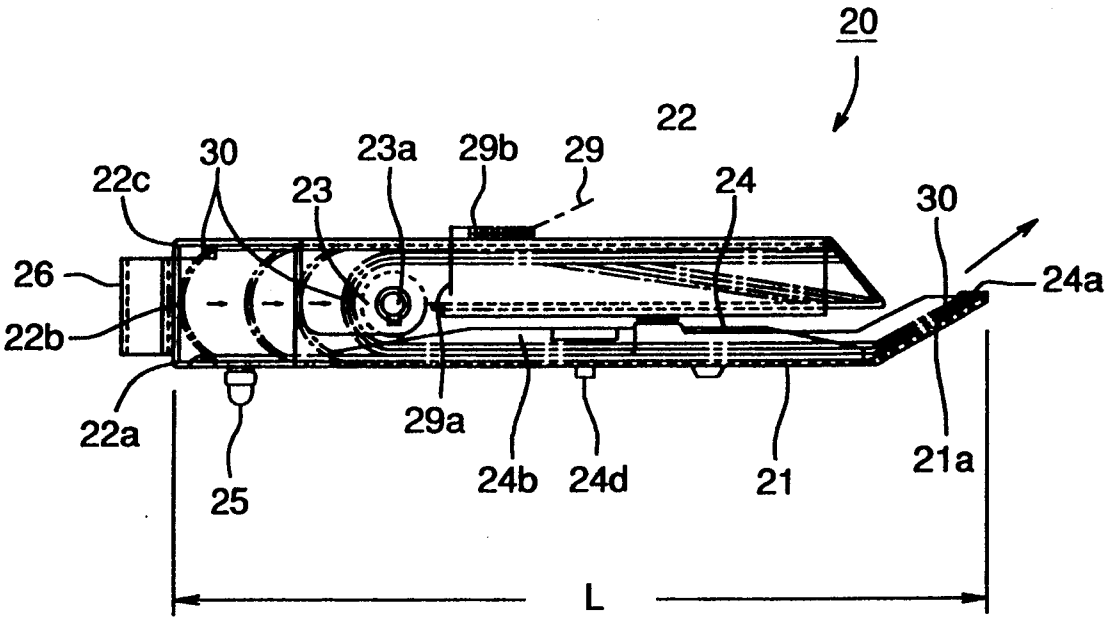
FIG. 2 is a side view of FIG. 1.

As shown in FIG. 1 and FIG. 2, the sheet feed cassette 20 of the present invention comprises: a base 21 for supporting a recording sheet 30; a casing member 22 for the recording sheet 30, one end of which is integrally connected with the left end of the supporting base 21; sheet guide rollers 23 which are rotatably supported by the casing member 22; a pair of regulation plates 24 which are provided slidably in upper and lower directions of the supporting base 21 in FIG. 1 and regulate the position of the recording sheet 30; a positioning pin 25 which is planted on the base portion of the supporting base 21; and a cassette support belt 26 provided on a left side portion 22b of the casing 22.

The supporting base 21 is a steel plate member which is finished by surface processing, and, for example, marketed under the trade name Silver Top. A right end portion 21a of the plate member is bent upward by a predetermined angle, and forms a carry-out portion of the recording sheet 30 which is conveyed in the arrowed direction.

Slide holes 21b formed in the upper and lower directions in FIG. 1 so that regulation plates 24 can slide in the holes, are symmetrically provided in both end portions in the upper and lower directions in FIG. 1 of the supporting base 21. Three surfaces, except for a right end portion of the supporting base 21, are raised to an appropriate height to reinforce a connection surface of the casing member 22 when the casing member is closed, which will be described later. On the upper surface of the supporting base 21, marks such as A2, A3R and Δ which indicate positions in the width direction of the recording sheet are symmetrically printed with respect to the center line of the supporting base in the upper and lower positions so that the recording sheet is positioned with side surfaces 24e of the sliding regulation plates 24 are coincident respectively with Δ marks. A pair of regulation plates are symmetrically provided with respect to the center lien of the supporting base in upper and lower positions. The regulation plates 24 are structured by a plate member made of the same steel plate as the supporting base 21. A right leading edge portion is bent upward by the same angle as that of the leading edge portion 21a of the supporting base 21, and a claw portion 24a, which is bent in the shape of a C in the width direction (in upper and lower directions in the drawing), is formed on the leading edge. The inner wall of the claw portion 24a forms a reference portion which is contacted with the recording sheets 30 when they are loaded, and also positively handles the recording sheets 30 one by one into the image forming apparatus 18.

The regulation plates 24 are operated as follows: two guide pins 24c, which are planted on the regulation plates 24, are engaged with slide holes 21b; the guide pins 24c are fixed from the direction of the base plate by screws 24d so that the guide pins 24c are slidably moved in the manner that the supporting base 21 is sandwiched between the regulation plates and screws; and thereby, the regulation plates 24 slide on the supporting base 21 in the slide holes 21b in the upper and lower directions (in FIG. 1).

Raised portions 24b which are so high enough to guide the loaded recording sheet 30 and bent at right angles are provided on the outer surfaces opposite to side end surfaces 24e in the upper and lower directions in FIG. 1 of the regulation plates 24. Inner surfaces of the raised portions 24b, which face each other, form guide surfaces for the recording sheet 30. Accordingly, when the side end surfaces 24e of the upper and lower regulation plates 24 are coincident with, for example, Δ marks of A2, the side end surfaces having the width (in the upper and lower directions) formed between both raised portions regulate the position of the recording sheet 30 of size A2, and also form guide surfaces for the recording sheet 30, and the width formed between both raised portions can be slidably changed according to the size of the recording sheet 30.

On the other hand, the casing member 22 is a member which is formed into a box-shape using, for example, a polypropylene material (P.P), which is a sheet-like synthetic resin material. As shown in the developed side sectional view in FIG. 3, the right end portion of the casing member 22 is integrally connected with the left end portion of the supporting base 21, and a lower hinge 22a, the section of which is formed into a corrugated profile, and an upper hinge 22c, which is formed in the same way as the hinge 22a and at a predetermined distance from the hinge 22a, are provided on the left side of the connecting portion. As shown in FIG. 2, when the casing member 22 is closed, a left side surface portion 22b is formed between the lower hinge 22a and the upper hinge 22c. Three delivery sheet guide rollers 23 are rotatably supported by both the raised side surfaces of the casing member (in the vertical direction of the drawing shown in FIG. 2 and FIG. 3) in a predetermined position of the left side of the upper hinge 22c, and integrally provided on a shaft 23a at predetermined intervals.

Both side surfaces which are raised upward and an upper surface portion which is bent in the shape of a C in the upper direction of the leading edge portion of the casing member as shown in the drawing (when the casing member 22 is closed, it forms a lower surface portion) are formed on the left side portion of the delivery sheet guide rollers 23, and main portions of mutual connecting portions are connected by ultrasonic machining so that the side surfaces and the upper surface portion are formed into a hollow box-shape which can hold the left side of a plurality of the recording sheets 30.

When, for example, ten or so sheets of A2 size recording sheets are loaded in the sheet feed cassette 20 structured as above, the recording sheets are loaded at first as follows; the casing member 22 is opened; and side end surfaces, which face each other, of regulation plates 24 coincide with Δ marks of A2 on the supporting base 21. Next, the right end surface of the recording sheet 30 is inserted in the manner that it is contacted with the inside of the claw portion 24a of the regulation plates 24, which is a reference for contact; the recording sheet is placed along the raised portions 24b of the regulation plates 24; the recording sheet is passed under the delivery sheet guide rollers 23; and the left side of the recording sheet is inserted into the hollow portion of the casing member 22 which is formed in a box-shape, and then the recording sheet is loaded in the cassette 20.

After the recording sheet 30 has been loaded as above, the casing member 22 is folded and closed in the manner that the casing member 22 is almost in parallel with the supporting base 21 after being rotated around upper and lower hinges 22a and 22c. The casing member 22 is integrally connected with the supporting base 21 by adhesive tape 27 (magic tape) provided on both side surfaces of the casing member and supporting base. Thus, a sheet feed cassette 20 which is provided in the image forming apparatus 18 is formed, the position of which is determined by a positioning pin 25 which is provided on the bottom surface of the supporting base 21.

At this time, the recording sheet 30 loaded in the sheet feed cassette 20 is positioned near the inside of the left side surface 22b at the left side of the circumferential surface of the sheet delivery guide roller 23, and folded in a U-shape in the initial setting condition of the recording sheet 30 as shown in FIG. 2. When the recording sheet 30 is conveyed, the folded portion of the recording sheet 30 is moved in the arrowed direction shown by a chain line, and fed using the circumferential surface of the sheet delivery guide roller as a guide. Accordingly, when the cassette 20 is mounted in the ADU unit (not shown in drawings) of the image forming apparatus 18, a load when the recording sheet 30 is fed out is greatly decreased, the recording sheet 30 is conveyed smoothly, and thereby jamming is prevented.

The length L in the longitudinal direction (left and right directions) formed when the casing member 22 is folded with respect to the supporting base 21 is about 310 mm, and thereby the length in the longitudinal direction of the cassette 20 can be reduced to about ½ of that of the A2 size recording sheet 30. Further, when the cassette 20 is mounted in the image forming apparatus 18, a cassette support belt 26 is provided on the left side surface portion 22b of the casing member 22 so that the cassette 20 can be carried, and thereby the weight of the sheet feed cassette 20 is reduced and the operability of the cassette 20 is remarkably improved.

As described above, the recording sheet 30 fed from the sheet feed cassette 20 is smoothly fed out around the circumferential surface of the delivery sheet guide roller 23, and is handled by the claw portion 24a of the regulation plate 24 so that double feeding of the recording sheet 30 is prevented, and thereby jamming during conveyance can be reduced.

Further, since the casing member is formed by a P.P. sheet made of synthetic resin, not only is the cassette 20 light, but also molding is easy. Further, when upper and lower hinges 22a, and 22c are formed together with the casing member, other hinge members are not specially necessary, and thereby the cost of the sheet feed cassette 20 becomes satisfactorily low.

When A3R recording sheets are loaded into the cassette 20, the regulation plate 24 is positioned at a mark Δ of A3R, and after that, the recording sheets 30 are loaded in the same way as the A2 recording sheets. In this case, since the length in the longitudinal direction of A3R sheets is shorter than that of A2 recording sheets, a back end stopper 29 shown by a chain line in FIG. 2, which is always provided as an attachment in a hole provided on the upper surface of the casing member, is inserted into the casing member 22 and integrally connected with the casing member 22 by, for example, adhesive tape 29b.

A bent portion 29a, which is bent downward by right angles with respect to the surface on which the back end stopper 29 is provided, is inserted into the casing member 22 so that the right end surfaces of the A3R recording sheets 30, which are turned in a U-shape when the casing member is closed, push the bent portion 29 and are regulated thereby. Accordingly, the bent portion 29 is not necessary when the A2 recording sheets are loaded.

Figure 4:
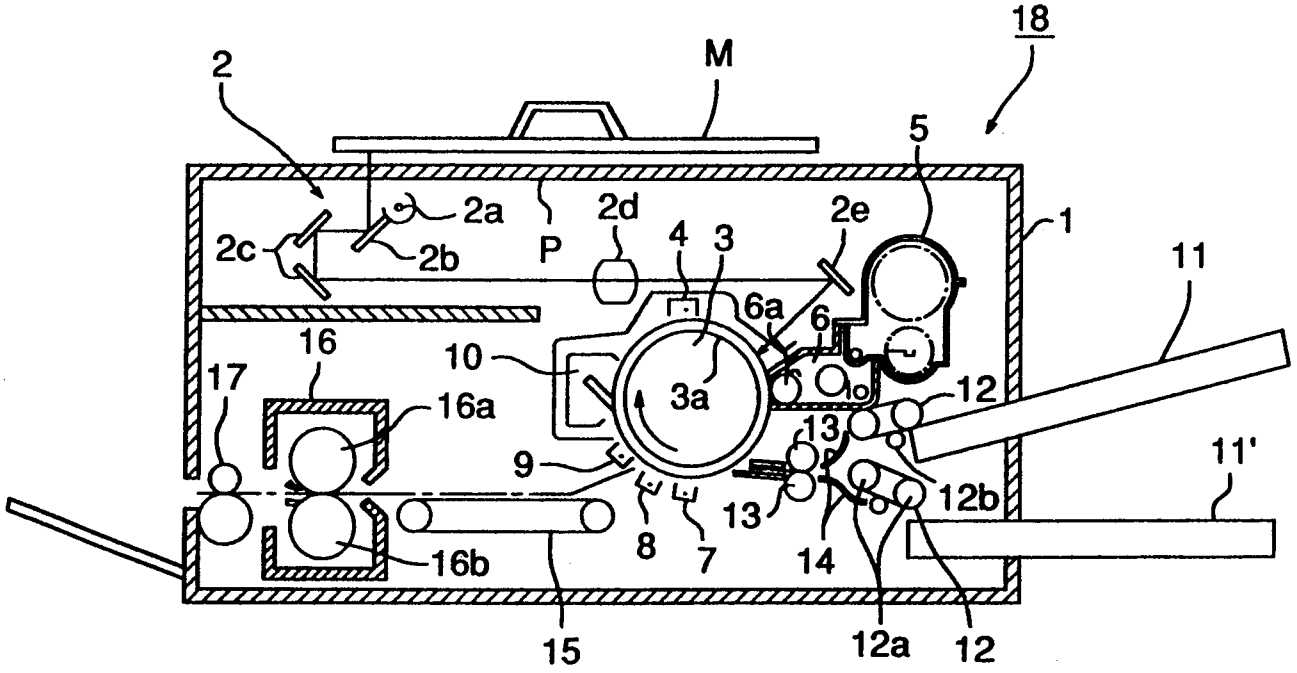
FIG. 4 is a side sectional view showing a structure of an image forming apparatus.

In this case, the sheet feed cassette 20 of the present invention can also be applied to the ADU unit which is built in the image forming apparatus, besides the example in which the cassette 20 is inserted into the apparatus 18 from the outside thereof like the sheet feed cassettes 11 and 11' which are inserted from the outside of the apparatus as shown in FIG. 4, and in which the recording sheets are fed through the sheet feed roller of the conveyance system. This is of course included within the scope of the present invention.

According to the sheet feed cassette of the present invention, when large-sized recording sheets such as A3 or A2 are loaded, the sheet feed cassette, which is light, whose operability is reasonably improved, and whose cost is low, can be provided to an image forming apparatus.

Figure 5:
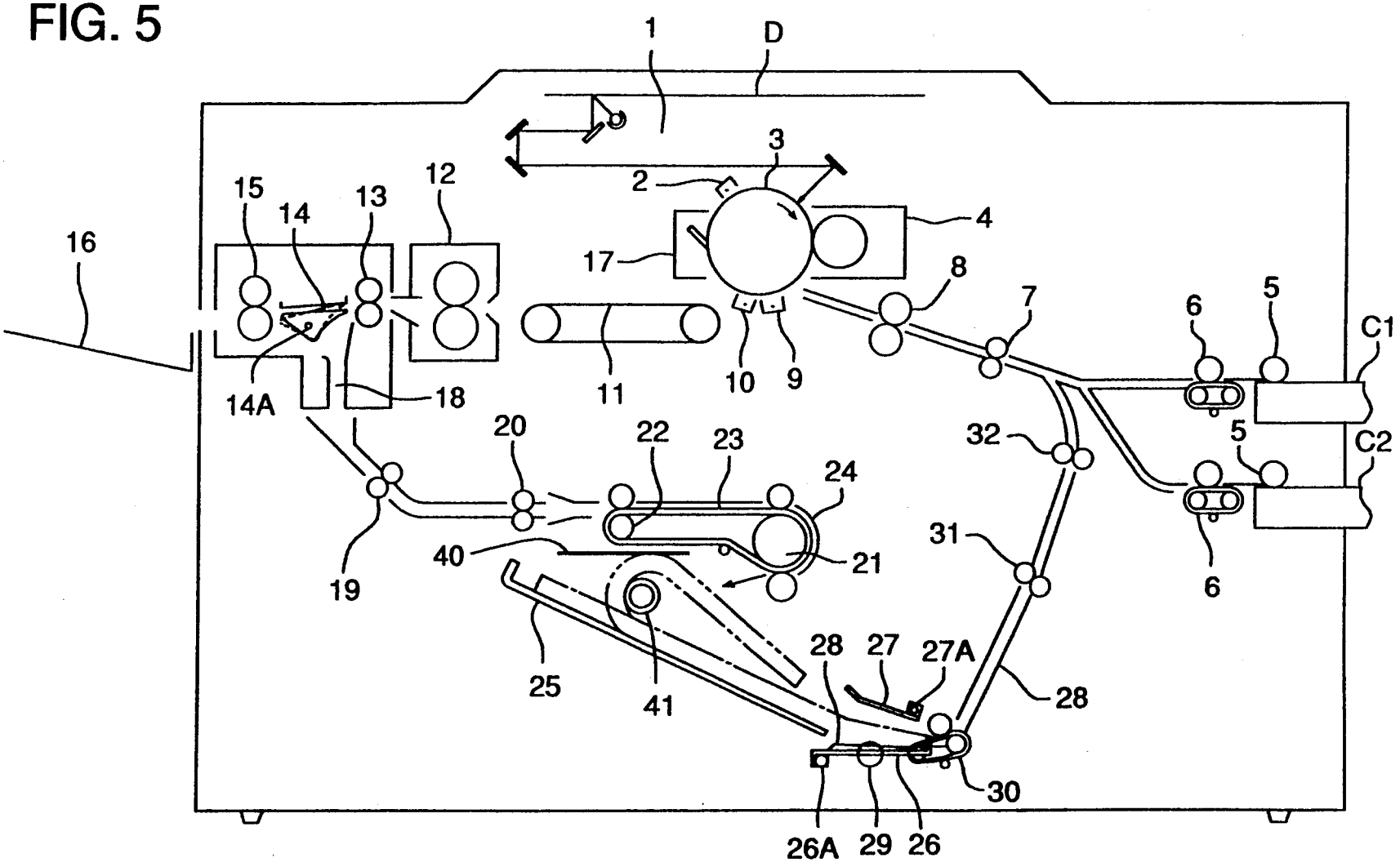
FIG. 5 is a sectional view showing a structure of the image forming apparatus according to an example of the second object of the present invention.

An example of the second object of the present invention will be shown in FIG. 5.

FIG. 5 shows an image forming apparatus in which a two-sided copying function is provided. When an image is copied on one side of a recording sheet, it is conducted by a publicly known image forming process which will be described as follows.

Namely, the image on the lower surface of document D is scanned and exposed into an electrostatic latent image by an exposure optical system 101 on the circumferential surface of a photoreceptor drum 103 which is previously charged by a charger 102, and the electrostatic latent image is developed into a toner image by a developing unit 104.

Recording sheets are conveyed one by one from a sheet feed cassette C1 or C2 by operations of a sheet feed roller 105 and a handling roller 106, conveyed to a timing roller 108 through a conveyance roller 107, and after that, fed in synchronization with the toner image on the photoreceptor drum 103.

After the toner image has been superimposed onto the recording sheet when the recording sheet has been fed, the toner image is transferred onto the recording sheet by a transfer unit 109. After the recording sheet has been separated from the circumferential surface of the photoreceptor drum 103, it is conveyed to a fixing unit 112 through a conveyance belt 111, and the toner image is fixed.

The recording sheet which has been fixed passes on the upper surface of a guide member 114 through a relay roller 113, and is delivered onto a tray provided outside the apparatus. Residual toner on the photoreceptor drum 103, from which the recording sheet has been separated, is cleaned and removed, and the photoreceptor 103 stands by for the next image formation.

On the other hand, when images are copied on both sides of the recording sheet, the guide member 114 is previously rotated counterclockwise around a support shaft 114A at the time when a two-sided copying mode is set, and is set at the position shown by a broken line.

The recording sheet on one side of which, that is, the upper surface of which the toner image has been fixed turns its conveyance direction downward along the guide member through the relay roller 113, and is conveyed into a conveyance guide 118.

The recording sheet conveyed into the conveyance guide 118 is fed to a reversal conveyance section, which is composed of a belt member 123 stretched between rollers 121 and 122, and a guide member 124 provided along the outer circumference of the belt 123, through conveyance rollers 119 and 120.

The recording sheet is delivered and placed on an intermediate stacker 125 from the arrowed direction under the condition that the image surface faces upward after the recording sheet has passed through the reversal conveyance section, and when copying is repeatedly conducted, the recording sheets are stacked on the stacker 125 as shown by a one-dotted chain line.

Recording sheets placed on the intermediate stacker 125 slip downward along its inclination, contacted with the rising portion of an auxiliary base plate 126, and thereby end surfaces of the recording sheets are arranged properly.

When the document D is reversed or replaced with a new one and copying is started, the auxiliary base plate 126 is rotated clockwise from the position shown in the drawing around a support shaft 126A. Next, a press member 127 above the recording sheets is urged to be rotated counterclockwise around a support shaft 127A, so that the recording sheets are contacted with the upper surface of a fixed guide plate 128 with pressure.

A sheet feed roller 129 and handling roller 130 start their rotations from the condition described above, and the recording sheets are conveyed out one by one from the lowest layer of stacked recording sheets, and fed to the timing roller 108 through conveyance rollers 131 and 132, and then the image is recorded on the rear surface of the recording sheet in the transfer process.

The guide member 114 is rotated clockwise in parallel with the transfer action of the image onto the rear surface of the recording sheet, and returns to the position shown by solid lines.

Thus, the recording sheet, on the front and rear surfaces of which images have been recorded, passes through above the upper surfaces of the guide member 114, and is delivered onto the delivery tray 116 in the same manner as that of single-sided copying.

In the image forming apparatus provided with the two-sided copying function, when a large-sized sheet is fed from the intermediate stacker 125, a control plate 140 can be provided on the upper portion of the intermediate stacker 125 and further a detachable turning guide member 141 can be provided on the stacker.

The turning guide member 141 is structured by a cylinder or an elliptic cylinder member, and setting of the two-sided copying mode in the image forming apparatus is inhibited only when the member is provided.

A large-sized recording sheet, which can not be loaded in the intermediate stacker 125, for example, A2 recording sheet, can be loaded in the stacker when the A2 recording sheet is folded in a U-shape between the control plate 140 and the turning guide member 141 as shown by a two-dotted chain line.

When the large-sized recording sheet is fed from the intermediate stacker 125, the image is recorded on only one side of the recording sheet after a recording sheet size selection button provided on an operation panel of the image forming apparatus has been pressed and the sheet feed processing for rear surface copying has been conducted.

In this example, the control plate 140 and the turning guide member 141 are provided in the intermediate stacker 125. However, it is of course possible that a large-sized recording sheet is loaded in a different type cassette, which is structured as follows: the cassette has the function of the control plate 140 and the turning guide member 141; the large-sized recording sheet is loaded in the cassette in the manner that the recording sheet is folded in a U-shape; and after that, the cassette is mounted in the intermediate stacker 125.

According to the second object of the present invention, a large-sized recording sheet can be fed without using the sheet feed cassette, and thereby, a large-sized sheet feed cassette which is scarcely used is not necessary; and further, floor space for mounting the sheet feed cassette becomes minimum, so that a practical image forming apparatus can be provided.

Figure 3:
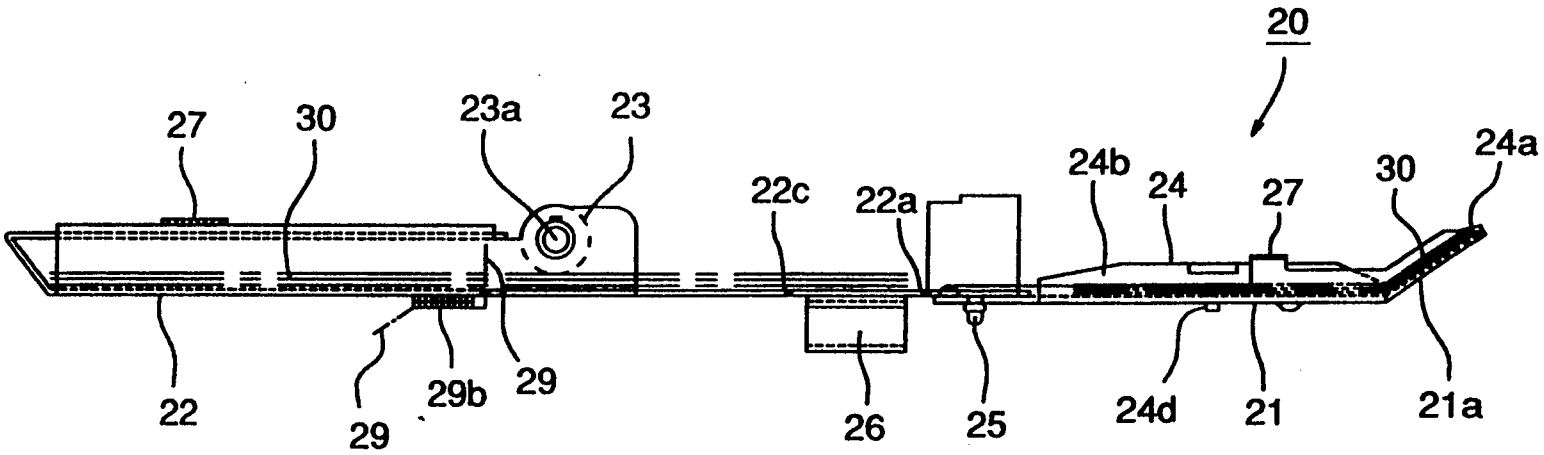
FIG. 3 is a side view showing a condition of a casing member when it is opened.

Next, an example in which an ADU (Auto Duplex Unit) is provided to the image forming apparatus having a two-sided copying function as shown in FIG. 5, and in which the sheet feed cassette for the large-sized sheets shown in FIGS. 1 to 3 is applied to the ADU, will be described as follows.

Figure 6:
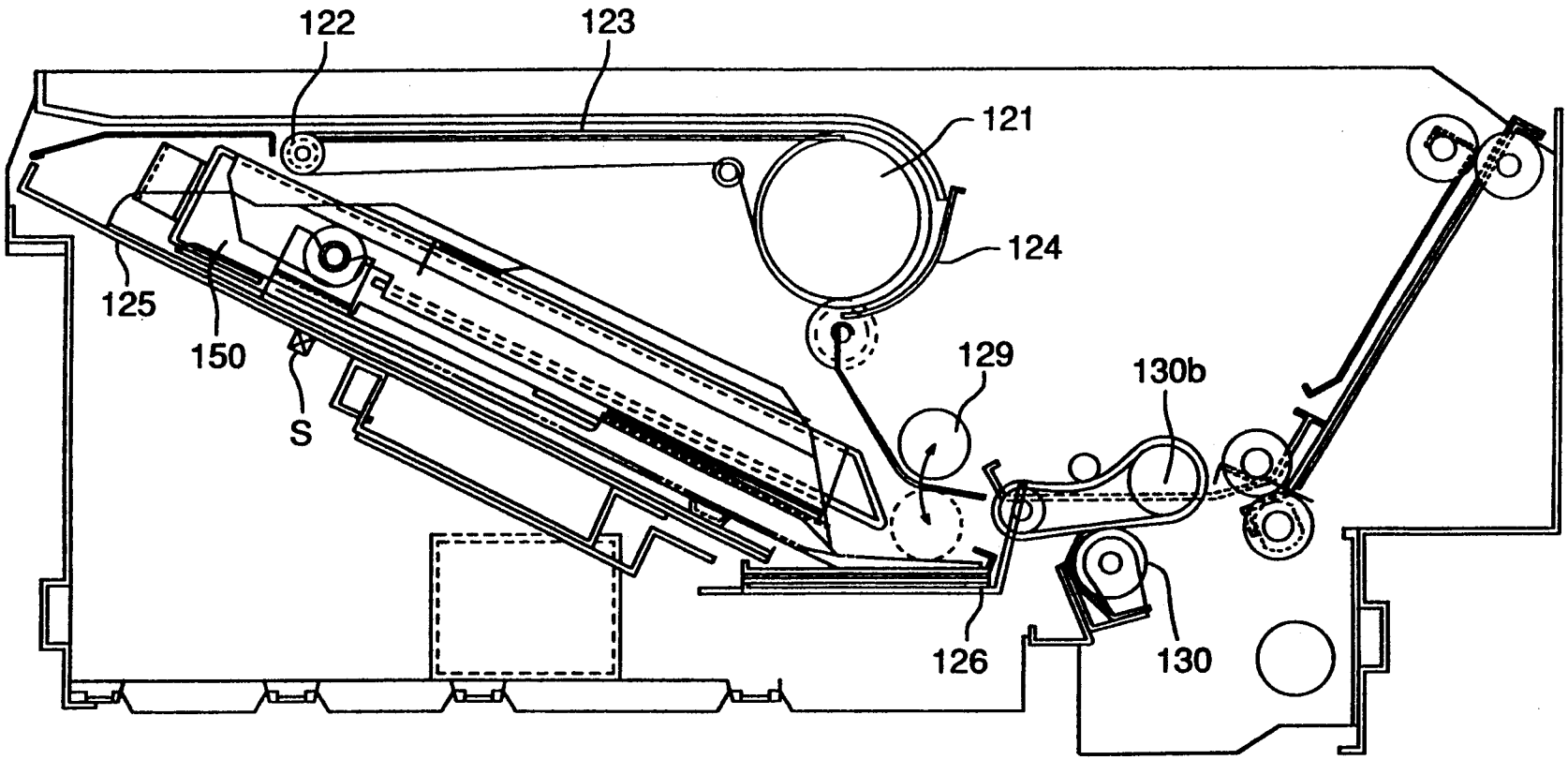
FIG. 6 is a sectional view showing a structure of an ADU (Automatic Duplex Unit) of the present invention.

FIG. 6 is an enlarged view of the ADU in which rollers 121, 122, a belt member 123, a guide plate 124 provided around the periphery of the belt member 123, an intermediate stacker 125, an auxiliary plate 126, a sheet feed roller 129, and a handling roller 130 are provided as one unit, and the ADU is detachable from the image forming apparatus.

When the large-sized recording sheet is fed from the ADU, the sheet feed cassette 150 for the large-sized recording sheet shown in FIGS. 1 to 3 is provided to the intermediate stacker section in the ADU, and after that, the sheet feed cassette 150 is provided to the image forming apparatus together with the ADU.

In this structure, when, for example, a recording sheet of size A2 is specified as the large-sized recording sheet by an inputting means which is provided on the panel and by which a predetermined size of recording sheet is inputted, a sensors detects that the sheet feed cassette 150 is provided to the ADU, and after that, the recording sheet of size A2 is detected by another sensor by which the recording sheet in the stack section of the ADU is detected. When the recording sheet of size A2 is detected in the above-described steps, the recording sheet of size A2 is ready to be copied. After this condition, when a copy button is pressed, the sheet feeding process for back side copying is conducted, and then, the recording sheet in the sheet feed cassette is conveyed to the image forming section by the conveyance means.

In this copying operation, when the size of the original document is a large-size such as size A2, and larger than the size of the platen glass, it is preferable that the optical system in the apparatus is stopped and the original document is synchronously exposed while it is synchronously moved with the photoreceptor.

Figure 7:
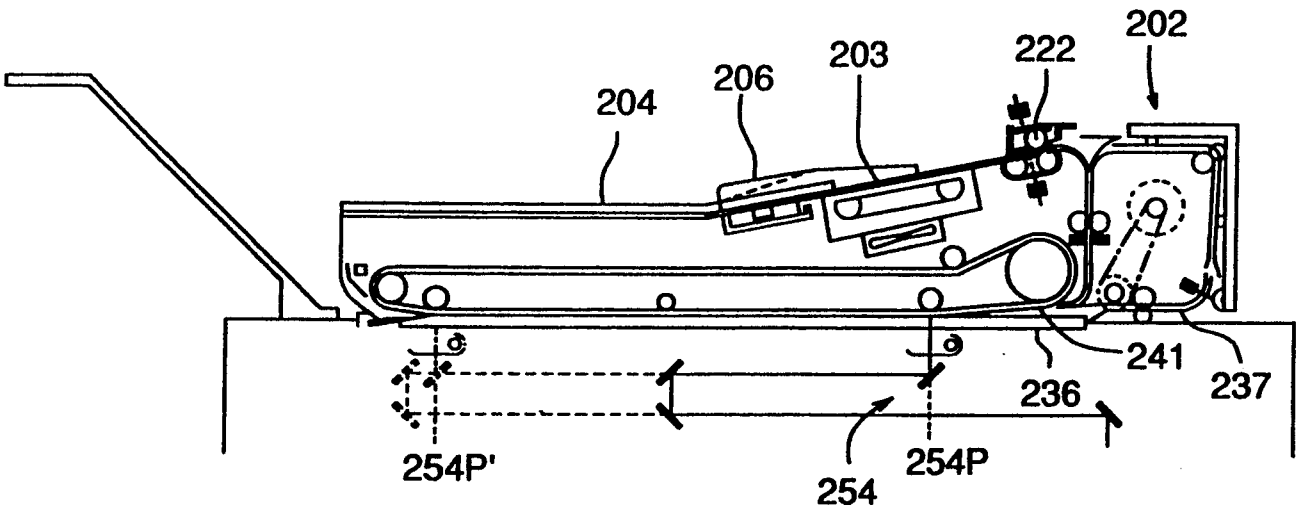
FIG. 7 is a sectional view showing a structure of an original document conveyance unit of the present invention.

FIG. 7 shows an original document conveyance unit in which the original document is synchronously exposed. This unit is structured in the manner that both the exposure mode, that is, the synchronous exposure mode, and the stop-exposure mode can be selected.

In the stop-exposure mode, the original document is conveyed by a conveyance belt 241, the belt 241 is stopped when the original document is advanced to a predetermined position on a platen glass 236, and the original document is stopped in the stop-exposure position. Then, while the optical system is moved between the two positions shown by numerals 254P and 254p' under the condition in which the original document is stopped, the original document is exposed and the copying operation is performed. After the copying operation has been completed, the original document is discharged from the platen glass 236 onto a discharging tray by the conveyance belt 241.

When the size of the original document is larger than that of the platen glass, a portion of the document protruded from the edge of the platen glass is not exposed and copied in the stop-exposure mode.

Therefore, when the original document, the size of which is larger than that of the platen glass, is processed, the synchronous exposure mode is selected and synchronous exposure can be conducted in the present invention. That is, in the synchronous exposure mode, the optical system is maintained under the condition in which it is stopped in the position, for example, shown by numeral 254P, and the original document is conveyed in synchronization with the movement of the photoreceptor by the conveyance belt 241. The original document is exposed while it is conveyed, and copied.

Due to the synchronous exposure, while a portion of the original document in which the exposure has been completed is discharged from the platen glass, other portions which are not exposed are conveyed onto the platen glass, and thereby, even a large-sized original document can be completely copied.

As described above, in the present invention, the sheet feed cassette for the large-sized recording sheet is provided to the ADU, and therefore, a sheet feed cassette for a standard-sized recording sheet can be maintained under the condition in which it is provided to the apparatus. This is preferable since, when a sheet feed box, the capacity of which is large, is used as the sheet feed cassette for the standard-sized sheets, it is not necessary to remove the sheet feed box from the apparatus.

Since the original document conveyance unit is structured in the manner in which synchronous exposure can be conducted in the unit, a large-sized original document, the size of which is larger than that of the platen glass, can be copied.

That is, due to the above-described structure according to the present invention, a large-sized original document, the size of which is larger than that of the platen glass, can be copied onto a large-sized recording sheet without reducing the size of the original document.

What is claimed is:

1. A sheet feed cassette for loading a recording sheet for an image forming apparatus, said sheet feed cassette being detachably provided in said image forming apparatus and comprising;

a supporting base forming a lower half of said cassette;

a casing member detachably mounted on said supporting base to form an upper half portion of said cassette, wherein the recording sheet can be loaded in a form of a U between said supporting base and said casing member, and one side of said cassette is cut out to form an opening through which said recording sheet is delivered to said image forming apparatus, one end of said casing member being connected with one end of said supporting base whereby said casing member can open or close the top of said supporting base, said one end of said casing member being connected to said one end of said supporting base by an upper hinge and lower hinge provided on the connecting portion; and a sheet delivery guide member disposed between the supporting base and the casing member and arranged substantially in parallel with a side of said cassette on which the opening is provided, wherein the U-shaped recording sheet is folded around said sheet delivery guide member.

2. The sheet feed cassette of claim 1, wherein the upper and lower hinges are formed together with the casing member, and a side surface portion of the a casing member is positioned between both the hinges when the casing member is folded.

3. The sheet feed cassette of claim 2, wherein the casing member is folded in the manner that the casing member is almost in parallel with the supporting base after being rotated around the upper and lower hinges.

4. The sheet feed cassette of claim 1, wherein the casing member is formed of synthetic resin.

5. The sheet feed cassette of claim 1, wherein the image forming apparatus includes an intermediate tray to temporarily store one-side-copied sheets, the sheet feed cassette is attached to the intermediate tray.

6. The sheet feed cassette of claim 5, wherein the image forming apparatus includes means for reading an original document, and when the reading means reads the original document, the reading means is kept a stop condition and the original document is conveyed along the reading means.

7. A sheet feed cassette for loading a recording sheet for an image forming apparatus, said sheet feed cassette being detachably provided in said image forming apparatus and comprising:

a supporting base forming a lower half of said cassette, a casing member detachably mounted on said supporting base to form an upper half portion of said cassette, wherein the recording sheet can be loaded in a form of a U between said supporting base and said casing member, one side of said cassette being cut out to form an opening through which said recording sheet is delivered to said image forming apparatus; and a sheet delivery guide member disposed between said supporting base and said casing member arranged substantially in parallel with a side of said cassette on which said opening is provided, wherein the U-shaped recording sheet is folded around the sheet delivery guide member, said sheet delivery guide member comprising a plurality of sheet guide rollers which are rotatable supported by both side surfaces of said casing member.

8. A sheet feed cassette for loading a recording sheet for an image forming apparatus, said sheet feed cassette being detachably provided in said image forming apparatus and comprising:

a supporting base forming a lower half of said cassette;

a casing member detachably mounted on a supporting base to form an upper half portion of said cassette, wherein a recording sheet can be loaded in a form of a U between said supporting base and said casing member, one side of said cassette being cut out to form an opening through which said recording sheet is delivered to said image forming apparatus, said casing member being fixed to said supporting base by adhesive tape provided on both side surfaces of said casing member and said supporting base when said casing member is formed; and a sheet delivery guide member disposed between said supporting base and said casing member arranged substantially in parallel with the side of said cassette on which said opening is provided, wherein the U-shaped recording sheet is folded around the sheet delivery guide member.

* * * * *